United States Patent [19]

Mazzeo et al.

[11] 4,221,249

[45] Sep. 9, 1980

[54] SCREWDRIVER ATTACHMENT

[75] Inventors: Charles F. Mazzeo, Scotch Plains; William T. Waddington, Edison, both of N.J.

[73] Assignee: Amerace Corporation, New York, N.Y.

[21] Appl. No.: 974,086

[22] Filed: Dec. 28, 1978

[51] Int. Cl.[3] ..... B25B 15/00

[52] U.S. Cl. ..... 145/50 D; 145/50 F

[58] Field of Search ..... 145/50 F, 50 D

[56] References Cited

U.S. PATENT DOCUMENTS

| | | | |
|---|---|---|---|
| 1,360,500 | 11/1920 | Coll | 145/50 F |
| 2,723,694 | 11/1955 | Ross | 145/50 F |
| 2,985,208 | 5/1961 | Hibbard et al. | 145/50 D |
| 3,245,446 | 4/1966 | Morifuji | 145/50 D |
| 3,452,373 | 7/1969 | Vosbikian et al. | 145/50 F |
| 3,517,714 | 6/1970 | Desbarats | 145/50 F |

FOREIGN PATENT DOCUMENTS

| | | | |
|---|---|---|---|
| 318300 | 1/1920 | Fed. Rep. of Germany | 145/50 F |
| 1071007 | 12/1959 | Fed. Rep. of Germany | 145/50 F |
| 1019020 | 1/1953 | France | 145/50 F |
| 1405902 | 6/1965 | France | 145/50 D |
| 710062 | 6/1966 | Italy | 145/50 F |
| 37722 | 3/1936 | Netherlands | 145/50 F |
| 567910 | 10/1975 | Switzerland | 145/50 F |
| 846337 | 8/1960 | United Kingdom | 145/50 D |

*Primary Examiner*—Othell M. Simpson
*Assistant Examiner*—J. T. Zatarga
*Attorney, Agent, or Firm*—Richard A. Craig; S. Michael Bender; Ken Richardson

[57] ABSTRACT

An elongated sleeve or tubular member is provided concentrically fixed about the shank of a screwdriver with the sleeve having an axially flexible section between its opposed ends to facilitate axial shortening of the sleeve when the screwdriver is used to rotate a fastener the head of which is captured within the open end of the sleeve proximal to the blade of the screwdriver. Such axial shortening of the sleeve automatically seats the screwdriver blade within the slot in the head of the fastener when the frictional force between the screw's threads and those of the tapped hole into which it is being driven overcomes the interference fit between the free end of the sleeve and the screw head.

3 Claims, 4 Drawing Figures

SCREWDRIVER ATTACHMENT

This invention relates generally to hand tools such as screwdrivers and more particularly to a screwdriver attachment for assisting a user in holding, piloting, starting, tightening, or withdrawing fasteners into or from a work piece.

The principal object of the invention is to provide such a screwdriver attachment which is simple to operate and inexpensive to construct.

To the attainment of the foregoing principal object, the present invention briefly described comprises an elongated sleeve or tubular member concentrically fixed about the shank of a screwdriver with the sleeve having an axially flexible section intermediate its opposed ends to facilitate axial shortening of the sleeve when the screwdriver is used to rotate a fastener the head of which is captured within the open end of the sleeve proximal to the blade of the screwdriver. Such axial shortening of the sleeve automatically seats the screwdriver blade within the slot in the head of the fastener when the friction between the screw's threads and the complementary threads in the tapped hole into which it is being driven overcomes the interference fit between the free end of the sleeve and the screw head.

A more thorough understanding of the present invention will be made apparent from a study of the following detailed description of a preferred embodiment in connection with the accompanying drawing in which.

Figure 1:
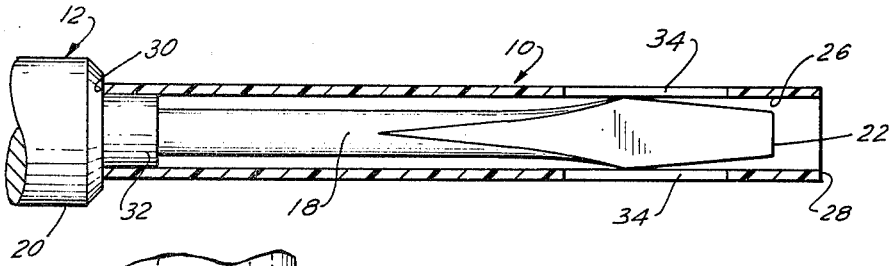
FIG. 1 is a schematic depiction, partly fragmented and partly in section, of the preferred form of screwdriver attachment according to the present invention.
Figure 2:
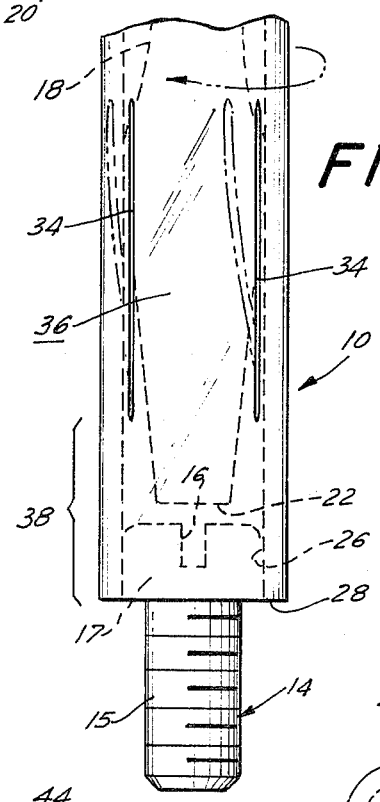
FIG. 2 is an enlarged portion of the screwdriver attachment of FIG. 1 showing a screw fastener captured therein.

Referring initially to FIG. 1, there is shown a preferred form of the invention comprising a flexible sleeve or tubular member 10 for use with a conventional bladed screwdriver 12 to assist the user of screwdriver 12 in safely and conveniently holding, piloting, starting, tightening, or withdrawing fasteners 14 into or from a tapped hole in a workpiece, such fastener 14 typically comprising a threaded shank 15 and a round head having a straight slot 16 (FIG. 2).

Screwdriver 12 includes a typical elongated shank 18 terminating at one end in a handle 20 and terminating at the other end in a fastener driving flat blade portion or tip 22. Of course it is to be understood that the invention contemplates the use of sleeve 10 with other types of screwdrivers, such as a phillips screwdriver or those used with screws having spline sockets and broached sockets to mention a few.

In its preferred form sleeve 10 is constructed from a transparent, resilient, thermoplastic material such as vinyl plastic. Sleeve 10 is of a length greater than the length of shank 18 and tip 22 and is provided with an inner diameter of a suitable size to enable the full longitudinal extent of sleeve 10 to be concentrically disposed about shank 18 and tip 22 substantially as shown in FIG. 1. The inner diameter of sleeve 10 also is such as to provide an interference fit between end 30 of sleeve 10 and an annular shoulder 32 disposed at the one end of shank 18 adjacent to and in abutting engagement with handle 20. The resulting interference fit should be sufficient to positively and fixedly retain sleeve 10 on annular shoulder 32 when sleeve 10 is subjected to either a torquing force or a longitudinal (axial) force as will be more fully described hereinafter. In the event the screwdriver 12 is either not provided with annular shoulder 32 or is not provided with an annular shoulder of a diameter suitable for positively retaining sleeve 10 thereon with the aforementioned interference fit, the invention comtemplates disposing an appropriately sized ferrule onto shank 18 as by simply wrapping circumferentially thereabout conventional friction tape until this region is built-up sufficiently to form the annular shoulder 32 capable of providing an interference fit with sleeve 10 having the desired gripping strength. The inner diameter of sleeve 10 also is chosen so that at its other or remotely extending free end 28, the sleeve bore 26 will provide a slight interference fit with a particular size of screw head.

Figure 4:
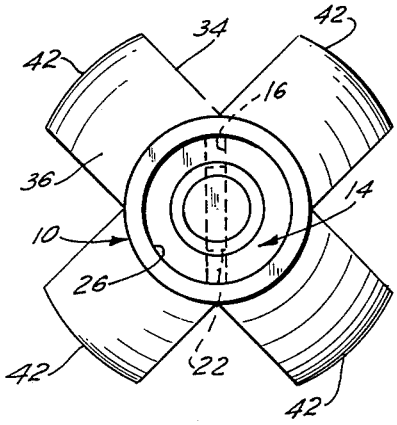
FIG. 4 is an end view taken along line 4—4 of FIG. 3.
Figure 3:
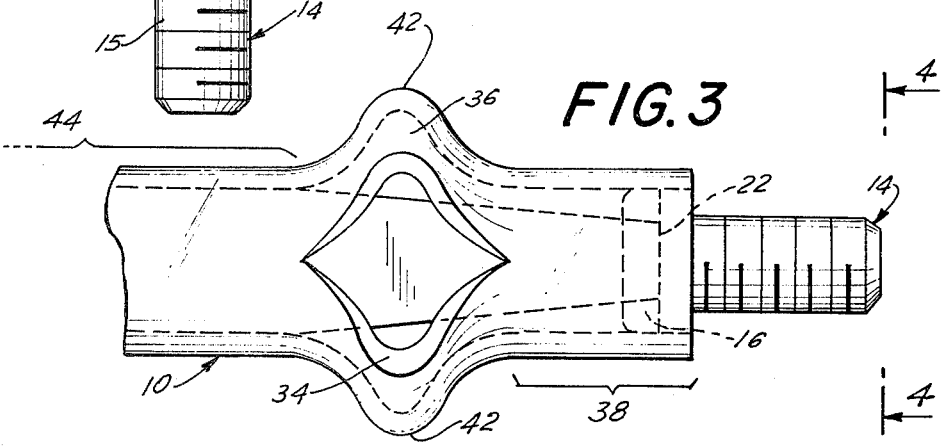
FIG. 3 is similar to FIG. 2, but shows the sleeve attachment in a contracted axially shortened condition.

Referring now to FIGS. 2 through 4, a section of sleeve 10 intermediate ends 28, 30 is provided with a plurality of circumferentially spaced apertures or slots 34 preferably at least three in number (although four are shown in the preferred embodiment) and preferably spaced equally about the circumference of the sleeve. Although apertures 34 may be positioned anywhere between ends 28, 30 they are preferably located proximal to end 28 substantially as shown. Each aperture 34 may comprise any one of a variety of shapes such as a rhombus, an oval, or a rectangle, but is preferably in the form of a narrow slit which extends parallel to the longitudinal axis of the sleeve and which readily may be formed with a razor blade or other sharp cutting instrument. Slits 34 define a plurality of circumferentially spaced relatively narrow strips 36 of sleeve 10; a different strip 36 being defined by every two adjacently positioned slits 34.

As mentioned, the other remaining sleeve end 28 defines a portion 38 which extends beyond the extremity of shank tip 22 and has an inside diameter of a size to form an interference fit between it and screw head 16. Hence, sleeve end 28 is adapted to enclose, capture, and retain screw head 16 therein, when portion 38 of sleeve 10 is fitted over the head 17 of screw 14. Due to the resilient characteristics of the plastic material from which sleeve 10 is formed and due to the size of inner sleeve diameter, the grip of this force fit is of sufficient strength to enable sleeve portion 38 to easily receive and securely hold screw 14 within the bore 26 of the sleeve portion 38 and easily allow the user to transport a captured screw 14 between different locations, such as for example, from a conventional slotted screw tray to a tapped aperture, as well as of sufficient strength to allow the user to torque capture screw 14 and start threadably advancing the screw as will be more fully explained hereinafter.

A loose or unattached screw 14 such as one that is not positioned within a screw tray so as to allow it to be picked up by its head 17 may be joined with sleeve 10, and thus screwdriver 12, by forcefully inserting screw head 17 within sleeve bore 26 at region 38 thereof by hand. In the event the loose screw 14 is seated upright within the screw tray as aforesaid or it happens to be assembled within a screw-receiving device, the screw may be captured by its screw head 17, by applying a longitudinally or axially directed force or pressure to sleeve 10 via the handle 20 of screwdriver 12 so as to enable sleeve region 38 to be pushed over and around screw head 17. This force is usually applied directly to handle 20 until either tip 22 abuttingly engages a portion of an external surface of screw head 17 or until tip 22 seats within screw slot 16, although this is not necessary as the grip of the force fit at end 28 is of sufficient strength to transport and start the assembly of captured screw 14 once the latter's head is received within bore 26 of portion 38 of sleeve 10. Hence, for this reason tip 22 and screw slot 16 are often slightly spaced apart and are often randomly oriented with respect to each other at the time they are joined as substantially seen in FIG. 2, i.e., the blade tip 22 is not aligned nor in registry with slot 16 of screw head 17.

Owing to slits 34, the application of a relatively slight longitudinal force to sleeve 10 will cause each strip 36 to bow outwardly or collapse while also simultaneously causing each slit 34 to expand or open. The amount by which each slit 34 opens and each strip collapses is proportional to the amount of the increasingly applied force. This action increases the diameter of sleeve 10 solely at the region of the developing folds or bulges 42 and opening slits 34, thereby effectively causing sleeve 10 to shorten axially in this region and to become contracted relative to the shank 18 of the screwdriver 12 as is best depicted at FIG. 3. Thus, for example, as sleeve 10 axially collapses sleeve region 38 responds by being drawn from its extended position beyond tip 22 to a second position adjacent the folds 42 developed at strips 36. It is to be noted further that during the time that strips 36 and slots 34 are folding and opening, respectively, portions 44 and 38 of sleeve 10 positioned on either side of the collapsing region remain relatively quiet, in that, the diameters associated with these portions 38, 44 do not expand circumferentially when subjected to the applied longitudinal force. This substantially aids the force fits formed at ends 28, 30 to perform their aforesaid intended function.

Thus, it may now be appreciated that once sleeve 10 has been positioned over and around screw head 17, tip 22 is seated within screw slot 16 of captured screw 14 by simply applying a longitudinally directed pressure to either screwdriver handle 20 or screw 14 until sleeve portion 38 sufficiently displaces axially relative to shank 18 in response to the applied pressure to allow tip 22 to be seated within slot 16 of screw head 17. In the event screw 14 and sleeve 10 are so joined that screw slot 16 and tip 22 are randomly oriented with respect to one another, a torquing force is simply applied to screwdriver 12 to rotate or turn tip 22 until it is aligned for entry into screw slot 16 as will be more fully described hereinafter.

The assembly of a captured screw 14 into a tapped aperture is started by applying a torquing force to handle 20 which causes attached sleeve 10 to be rotated therewith in the direction of the applied torquing force. The force fit formed at annular shoulder 32 and sleeve end 30 is of sufficient strength to allow sleeve 10 to be rotated with shank 18 without sleeve 10 slipping circumferentially or becoming separated therefrom. Similarly, the force fit formed at sleeve end 28 is of sufficient strength to allow the threads of captured screw 14 to engage the mating threads of the tapped aperture, as well as of sufficient strength to allow captured screw 14 to be partly assembled therein without permitting screw head 16 to turn circumferentially within the bore 26 of portion 38 even though screw head 16 is both spaced and disoriented with respect to tip 22.

To complete the assembly of captured screw 14 and to obtain the desired tightness of screw 14 within the tapped aperture, tip 22 must be aligned and seated at screw slot 16 when the frictional resistance provided by the threaded aperture so overcomes the grip of the force fit at end 28 that screw 14 no longer threadably advances. The desired alignment is obtained therebetween by simply continuing or increasing slightly the torquing force applied at handle 20 until tip 22 thereof is rotatably positioned for insertion into slot 16. In response to the applied torque, the portion of sleeve 10 containing slits 34 and strips 36 will twist slightly in the direction of the applied torque thus turning shank 18 while the remaining regions of sleeve 10 outboard of the portion containing slits 34 and strips 36, that is, sleeve regions 44 and 38 remain quiet or do not twist. As mentioned, this substantially aids both of the force fits formed at sleeve ends 28 and 30 to perform their aforesaid holding functions while tip 22 is being rotatably positioned for entry into slot 16. Upon achieving the proper alignment between tip 22 and screw slot 16 a continued or slightly increased longitudinal force applied to handle 20 will automatically seat tip 22 within screw slot 16. The assembly of screw 14 is completed by continuing both the longitudinal force and the torquing force until screw 14 is torqued to the desired tightness within the tapped aperture.

It is to be noted that in the event a longitudinal/torquing force is applied to the shank of a captured screw 14 to obtain the desired alignment between tip 22 and screw slot 16, sleeve 10 responds in substantially the identical manner as when such forces are applied to handle 20. Likewise, during the act of extracting screw 14 from a screw-receiving device (i.e., a tapped hole), sleeve 10 functions in the identical manner as it does when screw 14 is being assembled, except that the sequence of functions employed to extract assembled screw 14 occur in a reverse order of those employed to assemble it.

In an actual example of a preferred embodiment of the invention, a 4.25 inch long tube of vinyl plastic having an inner diameter of 0.370 inches and a wall thickness of 0.062 inches was fixedly secured about the shank of a Stanley Handyman screwdriver Model 3007-4. The shank of the screwdriver adjacent the handle was built-up by wrapping masking tape thereabout and one end of the tube was force fit over the built-up section in abutting engagement with the handle of the screwdriver. The tube's free end extended beyond the shank tip of the screwdriver approximately 0.250 inches. Before securing the tube about the shank of the screwdriver four equally circumferentially spaced slits were cut into the tube approximately 0.750 inches from the free end thereof with the slits extending along the tube a distance of about 1.50 inches to produce a section of increased axial flexibility. The resulting screwdriver and its attachment was then successfully employed to capture binding head screws (No. 1032 with a 0.380 inch head diameter) from a slotted pick-up tray, start the screws in the tapped holes of the terminals in an electrical terminal block (Buchanan® Model B106), and tighten the screws until the heads thereof were bottomed onto an electrical conductor. Initial torquing of the screws was effected only by the interference fit between the free end of the tube and screw head. Subsequently, slight longitudinal pressure was exerted axially in the direction of the screw while torquing was continued whereupon the tube axially shortened via its intermediate flexible section and the shank tip of the screwdriver automatically seated in the slot of the screw head thus facilitating complete positive tightening of each screw in its corresponding complementary threaded hole in the terminal block terminal.

Various changes and modifications to the particularly disclosed embodiment will now be apparent to those skilled in the art and evidently may be made without departing from the spirit and scope of the invention. By way of example, handle 20 could be provided with a one-way clutch of a kind fully described for example in U.S. Pat. No. 3,887,981, assigned to the same assignee as the present invention, and incorporated herein by this reference. Thus, the invention contemplates adapting handle 20 to house such a one-way clutch for the purpose of amplifying the torque applied thereto which will enable screw 14 to be assembled in more rapid fashion. Accordingly, the particular disclosed embodiments are intended in an illustrative and not in a limiting sense. The true scope and spirit of the invention is set forth in the appended claims.

What I claim is:

1. A screwdriver attachment comprising a tubular sleeve of flexible material, said sleeve having first and second ends and a plurality of circumferentially spaced slots substantially parallel to the axis of said sleeve and extending through the wall of said sleeve and substantially uniformly spaced from each other, said slots positioned only in a longitudinally intermediate portion of said sleeve so as to be spaced a first predetermined distance from said first end and a second predetermined distance from said second end, said sleeve further having a first circumferentially continuous end portion between said slots and said first end and a second circumferentially continuous end portion between said slots and said second end, such that said first end portion may grip the head of a screw and said second end portion may grip the shaft of a screwdriver.

2. The attachment of claim 1 wherein said material is thermoplastic.

3. The attachment of claim 2 wherein said thermoplastic material is vinyl.

* * * * *